US010267611B2

(12) United States Patent
Lownds et al.

(10) Patent No.: US 10,267,611 B2
(45) Date of Patent: Apr. 23, 2019

(54) WIRELESS DETONATORS WITH STATE SENSING, AND THEIR USE

(75) Inventors: Charles Michael Lownds, Salt Lake City, UT (US); Walter Hardy Piel, Troisdorf (DE)

(73) Assignee: ORICA INTERNATIONAL PTE LTD., Singapore (SG)

( * ) Notice: Subject to any disclaimer, the term of this patent is extended or adjusted under 35 U.S.C. 154(b) by 920 days.

(21) Appl. No.: 14/114,289

(22) PCT Filed: Apr. 27, 2012

(86) PCT No.: PCT/US2012/035397
§ 371 (c)(1),
(2), (4) Date: Oct. 28, 2013

(87) PCT Pub. No.: WO2012/149277
PCT Pub. Date: Nov. 1, 2012

(65) Prior Publication Data

US 2014/0053750 A1 Feb. 27, 2014

Related U.S. Application Data

(60) Provisional application No. 61/480,021, filed on Apr. 28, 2011.

(51) Int. Cl.

| | |
|---|---|
| ***F42D 1/05*** | (2006.01) |
| ***F42C 11/06*** | (2006.01) |
| ***F42D 5/00*** | (2006.01) |

(52) U.S. Cl.
CPC ..... *F42D 1/05* (2013.01); *F42C 11/06* (2013.01); *F42D 5/00* (2013.01)

(58) Field of Classification Search
CPC ..... F42D 1/05
USPC ..... 102/313, 213
See application file for complete search history.

(56) References Cited

U.S. PATENT DOCUMENTS

| | | | | |
|---|---|---|---|---|
| 5,159,149 | A | 10/1992 | Marsden | |
| 5,706,892 | A * | 1/1998 | Aeschbacher, Jr. | E21B 17/028 166/66 |
| 6,789,483 | B1 | 9/2004 | Jennings, III et al. | |
| 6,901,865 | B1 | 6/2005 | Thomson et al. | |

(Continued)

FOREIGN PATENT DOCUMENTS

| | | |
|---|---|---|
| WO | WO 87/00265 A1 | 1/1987 |

OTHER PUBLICATIONS

International Search Report for PCT/US2012/035397, dated Dec. 6, 2012.

(Continued)

*Primary Examiner* — Reginald Tillman, Jr.
(74) *Attorney, Agent, or Firm* — Nixon & Vanderhye P.C.

(57) ABSTRACT

Wireless detonator systems present opportunities for controlled blasting of rock without the encumbrances of physical wired connections at the blast site. Disclosed herein are wireless detonator assemblies, which sense the state of environmental condition(s) of their immediate vicinity, and which are active to receive and/or process a command signal to FIRE only if the environmental condition(s) are deemed suitable or appropriate according to predetermined parameters. Also disclosed are improved methods of blasting involving such wireless detonator assemblies, as well as corresponding wireless electronic primers.

22 Claims, 5 Drawing Sheets

(56) References Cited

U.S. PATENT DOCUMENTS

| | | | | |
|---|---|---|---|---|
| 7,383,882 | B2 * | 6/2008 | Lerche | E21B 41/00 166/250.01 |
| 7,568,429 | B2 | 8/2009 | Hummel et al. | |
| 7,755,050 | B2 | 7/2010 | Colson et al. | |
| 7,778,006 | B2 | 8/2010 | Stewart et al. | |
| 7,929,270 | B2 | 4/2011 | Hummel et al. | |
| 2002/0088620 | A1 | 7/2002 | Lerche et al. | |
| 2008/0156217 | A1 | 7/2008 | Stewart et al. | |
| 2008/0302264 | A1 * | 12/2008 | Hummel | F42B 3/113 102/215 |
| 2009/0193993 | A1 | 8/2009 | Hummel et al. | |
| 2009/0314176 | A1 | 12/2009 | Lownds et al. | |

OTHER PUBLICATIONS

International Preliminary Report on Patentability, dated Oct. 29, 2013.

Patentability Examination Report in corresponding Peruvian patent application, Case File: 0002421-2013/DIN; dated Oct. 28, 2013.

English Translation of Japanese Office Action/Notification of Reason(s) for Rejection for corresponding Japanese Patent Application No. 2014-508587, dated Apr. 11, 2015.

* cited by examiner

WIRELESS DETONATORS WITH STATE SENSING, AND THEIR USE

This application is the U.S. national phase of International Application No. PCT/US2012/035397 filed 27 Apr. 2012 which designated the U.S. and claims priority to U.S. Provisional Application No. 61/480,021filed 28 Apr. 2011, the entire contents of each of which are hereby incorporated by reference.

FIELD OF THE INVENTION

The invention relates to the field of detonators and associated components, and methods of blasting employing such devices. In particular, the invention relates to detonator assemblies that are substantially free of physical connections with an associated blasting machine, and to improvements in the safety of such wireless detonator assemblies.

BACKGROUND TO THE INVENTION

In mining operations, the efficient fragmentation and breaking of rock by means of explosive charges demands considerable skill and expertise. In most mining operations explosive charges are planted in appropriate quantities at predetermined positions within the rock. The explosive charges are then actuated via detonators having predetermined time delays, thereby providing a desired pattern of blasting and rock fragmentation. Traditionally, signals are transmitted to the detonators from an associated blasting machine via non-electric systems employing low energy detonating cord (LEDC) or shock tube. Electric detonators have also been used with some success. Electric detonators are typically attached to a harness wire, and actuate upon receipt of a simple electrical signal. Alternatively, electrical wires may be used to transmit more sophisticated signals to and from electronic detonators. For example, such signaling may include ARM, DISARM, and delay time instructions for remote programming of the detonator firing sequence. Moreover, as a security feature, detonators may store firing codes and respond to ARM and FIRE signals only upon receipt of matching firing codes from the blasting machine. Electronic detonators can be programmed with time delays with an accuracy of 1 ms or less.

The establishment of a wired blasting arrangement involves the correct positioning of explosive charges within boreholes in the rock, and the proper connection of wires between an associated blasting machine and the detonators. The process is often labour intensive and highly dependent upon the accuracy and conscientiousness of the blast operator. Importantly, the blast operator must ensure that the detonators are in proper signal transmission relationship with a blasting machine, in such a manner that the blasting machine at least can transmit command signals to control each detonator, and in turn actuate each explosive charge. Improper physical connections between components of the blasting arrangement can lead to loss of communication between blasting machines and detonators, with inevitable safety concerns. Significant care is required to ensure that the wires run between the detonators and an associated blasting machine without disruption, snagging, damage or other interference that could prevent proper control and operation of each detonator via the attached blasting machine.

Wireless detonator systems offer the potential for circumventing these problems, thereby improving safety and/or operational efficiency at the blast site. By avoiding the use of physical connections (e.g. electrical wires, shock tubes, SEDC, or optical cables) between detonators, and other components at the blast site (e.g. blasting machines) the possibility of improper set-up of the blasting arrangement is reduced. Wireless detonators and corresponding wireless detonator systems are also more amenable to application with automated mining operations, with robotic set-up of detonators and associated explosives in the field, since wireless detonators are not burdened by the complexities of 'tieing-in' to harness lines at the blast site.

However, the development of wireless blasting systems presents formidable technical challenges with regard to safety. For example, in direct contrast to traditional electronic detonators that are "powered-up" to receive command signals only once attached to a harness wire at the blast site, wireless detonators must each comprise their own independent or internal power supply (an "operating power supply") sufficient to power means for receiving, processing, and optionally transmitting wireless signals at the blast site. The mere presence of this operating power supply itself presents an inherent risk of inadvertent actuation for wireless detonators. For example, accidental or inappropriate application of the operating electrical power to the firing circuitry during transportation and storage could result in unintentional detonator actuation. Furthermore, since wireless detonators are 'continuously' powered they are at risk of receiving or acting upon inappropriate or spurious command signals at the blast site, even in locations prior to their placement at the blast site. Thus, there remains a great need in the art to improve the safety of blasting systems that employ electronic detonators, and in particular wireless systems.

SUMMARY OF THE INVENTION

It is an object of the present invention, at least in preferred embodiments, to provide a wireless detonator assembly with improved safety.

It is another object of the present invention, at least in preferred embodiments, to provide a method for firing one or more electronic detonators at a blast site.

Certain exemplary embodiments provide a wireless detonator assembly for use in connection with a blasting machine that transmits at least one wireless command signal to the wireless detonator, the wireless detonator assembly comprising:

a detonator comprising a shell and a base charge for actuation;

command signal receiving and processing module for receiving and processing the at least one wireless command signal from the blasting machine;

at least one state sensor to sense at least one environmental condition in an immediate vicinity of the wireless detonator assembly; and an activation/deactivation module to render the wireless detonator assembly capable of actuation in response to a command signal to FIRE only when the at least one state sensor senses that the at least one environmental condition falls within pre-determined parameters suitable for blasting, the wireless detonator assembly otherwise maintaining a safe mode incapable of receiving and/or responding to a command signal to FIRE.

Further exemplary embodiments provide methods for blasting rock pre-drilled with boreholes, the methods comprising the steps of:

1) assigning to each borehole at least one wireless detonator assembly as described herein;

2) optionally using a hand-held device or logger to communicate with each assigned wireless detonator assembly to read and/or program data into each detonator;

3) connecting each detonator to an explosive charge to form a primer;

4) pushing or lowering each primer into the borehole;

5) loading explosive into each borehole;

6) optionally stemming each borehole;

7) transmitting wireless command signals to control and FIRE each detonator;

wherein at any time the method further comprises: sensing at least one environmental condition in an immediate vicinity of each wireless detonator assembly, each assembly rendered incapable of actuation at any time if the at least one environmental condition is or becomes outside of predetermined conditions for blasting.

Further exemplary embodiments provide for a wireless electronic primer for use in connection with a blasting machine, said blasting machine controlling said wireless electronic primer via at least one wireless command signal, the wireless electronic primer comprising:

the wireless detonator assembly as described herein;

an explosive charge in operative association with said detonator, such that actuation of said base charge circuit causes actuation of said explosive charge;

said command signal receiving and processing module in signal communication with said detonator such that upon receipt of a command signal to FIRE by said command signal receiving and processing module said base charge and thus said explosive charge are actuated, providing said at least one state sensor senses environmental conditions that fall within pre-determined parameters suitable for blasting.

Definitions

Activation/deactivation module: refers to any part of a wireless detonator assembly as described herein, which is capable by any means to activate and/or to deactivate the wireless detonator assembly at least in terms of its ability to receive and/or respond to a wireless command signal to FIRE. An activation/deactivation module operates in conjunction with one or more state sensors of the wireless detonator assembly to activate the assembly (or to keep the assembly active) for firing of the detonator if favourable or suitable environmental conditions are detected in the immediate vicinity of the wireless detonator assembly, and/or to deactivate the assembly (or to keep the assembly in an inactive "safe" mode) when unfavourable or unsuitable environmental conditions are detected in the immediate vicinity of the wireless detonator assembly. The activation/deactivation module may be an individual electronic device, an integrated circuit, or an assembly of electronic device(s) and/or integrated circuits.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge, for example in a booster or primer.

Blasting machine: refers to any device that is capable of being in signal communication with electronic detonators, for example to send ARM, DISARM, and FIRE signals to the detonators, and/or to program the detonators with delay times and/or firing codes. The blasting machine may also be capable of receiving information such as delay times, firing codes or data regarding the environmental conditions in the immediate vicinity of the detonators, from the detonators directly, or this may be achieved via an intermediate device such as a logger to collect detonator information and transfer the information to the blasting machine.

"Booster" and "Primer": a booster refers to any portion of explosive material that, when associated with a detonator forms a primer such that the explosive material is caused to actuate or ignite upon receipt of energy from actuation of the base charge. In turn, if a primer is associated with further explosive material in the form of an explosive charge for example in a borehole, the actuation of the portion of explosive material of the primer may cause actuation or ignition of the explosive charge for fragmentation of rock surrounding the borehole.

Central command station: refers to any device that transmits signals via radio-transmission or by direct connection, to one or more blasting machines. The transmitted signals may be encoded, or encrypted. Typically, the central blasting station permits radio communication with multiple blasting machines from a location remote from the blast site.

Charge/charging: refers to a process of supplying electrical power from a power supply to a charge storage device, with the aim of increasing an amount of electrical charge stored by the charge storage device. As desired in selected embodiments, the charge in the charge storage device may surpass a threshold sufficiently high such that discharging of the charge storage device via a firing circuit causes actuation of a base charge associated with the firing circuit.

Charge storage device: refers to any device capable of storing electrical charge. Such a device may include, for example, a capacitor, diode, rechargeable battery or activatable battery. At least in preferred embodiments, the potential difference of electrical energy used to charge the charge storage device is less or significantly less than the potential difference of the electrical energy upon discharge of the charge storage device into a firing circuit. In this way, the charge storage device may act as a voltage multiplier, wherein the device enables the generation of a voltage that exceeds a predetermined threshold voltage to cause actuation of a base charge connected to the firing circuit.

Clock: encompasses any clock suitable for use in connection with a wireless detonator of the invention, for example to count down a deployment window, a time window for a blast, or a delay time. In particularly preferred embodiments, the term clock relates to a crystal clock, for example comprising an oscillating quartz crystal of the type that is well known, for example in conventional quartz watches and timing devices. Crystal clocks may provide particularly accurate timing in accordance with preferred aspects of the invention. For the most sophisticated blasting applications, the wireless detonator device may even encompass a chip-scale atomic clock (as disclosed for example in http://spectrum.ieee.org/semiconductors/devices/chipscale-atomic-clock/, incorporated herein by reference).

Deployment window: refers to any time period that can be programmed into a wireless electronic detonator as described herein, within which state sensors are inoperative, or at least the wireless detonator assembly is non-responsive to such state sensors. For example, the deployment window may permit a wireless detonator assembly to be transported or deployed at a blast site without the complications of environmental monitoring.

Electromagnetic energy: encompasses energy of all wavelengths found in the electromagnetic spectra. This includes wavelengths of the electromagnetic spectrum division of y-rays, X-rays, ultraviolet, visible, infrared, microwave, and radio waves including UHF, VHF, Short wave, Medium Wave, Long Wave, VLF and ULF. Preferred embodiments use wavelengths found in radio, visible or microwave division of the electromagnetic spectrum.

Environmental condition: refers to any parameter, condition or measurable state of the medium or materials in a general or immediate vicinity of a wireless detonator assembly as described herein. Such parameters, conditions or states may include one or more of the following non-limiting list: visible light, other electromagnetic radiation, temperature, humidity, moisture content, density of surrounding material, pressure, vibration, acceleration, motion etc. as detected by one or more state sensors of a wireless detonator assembly. To render a wireless detonator assembly "active" to receive and process a command signal to FIRE its associated or component detonator, the sensed environmental condition(s) must satisfy pre-determined parameters that are appropriate or previously approved for the blast. Such parameters as measured by the state sensors may require a zero or near zero reading by the state sensors (e.g. a lack or almost complete lack of vibration, acceleration, or motion), or may be required to be at or very close to a specific value (e.g. a precise moisture content) or may be required to exceed or not exceed a predetermined threshold value (e.g. a suitable low level of light at a given time, or as received over a given time period). In further embodiments the sensed environmental conditions must fall within an approved or predetermined range of parameters for the blast (e.g. density conditions indicative that the wireless detonator assembly is appropriately surrounded by explosive material and/or stemming material). Thus, such predetermined environmental conditions may be limited within or at strict parameters, or pertain to a range of parameters as deemed appropriate for the blast, and optionally taking into consideration blast site conditions. Moreover, such environmental conditions may be sensed at one time, on several occasions, or continuously over a specific period, before an assessment is made regarding whether those conditions meet the requirements of specific parameters required for a particular blast.

Hand-held device or logging device: includes any device suitable for recording information with regard to a detonator at the blast site. Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator such as data corresponding to environmental conditions, and preferably means to transfer this data to a central command station or one or more blasting machines. One function of the logging device may be to read the detonator/assembly ID so that the detonator can be "found" by an associated blasting machine, and have commands such as FIRE commands directed to it as appropriate.

Immediate vicinity: refers to an area or volume around a wireless detonator assembly, comprising rock, water, air and any other materials that constitute the environment around or surrounding the wireless detonator. For example, the immediate vicinity may include all materials within 1 cm, 10 cm, 1 m, 5 m or 20 m or more of the external surfaces of the wireless detonator assembly and its components, or may in other embodiments include only the materials contacting the external or internal surfaces of the wireless detonator assembly. Micro-nuclear power source: refers to any power source suitable for powering the operating circuitry, communications circuitry, or firing circuitry of a detonator or wireless detonator assembly according to the present invention. The nature of the nuclear material in the device is variable and may include, for example, a tritium based battery.

Passive power source: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a passive power source is a power source that may be charged and discharged with ease according to received energy and other signals. Most preferably the passive power source is a capacitor.

Power source: refers to any power source that can provide a continuous, constant, intermittent, or selective supply of electrical energy. This definition encompasses devices that direct current such as a battery or a device that provides a direct or alternating current. Typically, a power source provides power to a command signal receiving and/or processing means, to permit reliable reception and interpretation of command signals derived from a blasting machine.

Preferably: identifies preferred features of the invention. Unless otherwise specified, the term preferably refers to preferred features of the broadest embodiments of the invention, as defined for example by the independent claims, and other inventions disclosed herein.

State sensor: refers to any component or device that is able to take measurements or undertake analysis of an environmental condition or parameter for example selected from but not limited to: visible light, other electromagnetic radiation, temperature, humidity, moisture content, pressure, density of surrounding material, vibration of surrounding material, acceleration of the sensor in response to movement, motion etc. For example, a state sensor for temperature would include a thermometer, preferably with some means to obtain temperature data, and to transfer such data to another component or device. An example of a vibration state sensor would include an accelerometer, a vibration sensor, or a level. An example of a density sensor may include a device for emitting and/or receiving acoustic energy to assess a density of a surrounding or adjacent medium to the sensor (e.g. to assess whether the medium comprises rock, gravel, soil, water, air etc.)

Top-box: refers to any device forming part of a wireless detonator assembly that is adapted for location at or near the surface of the ground when the wireless detonator assembly is in use at a blast site in association with a bore-hole and explosive charge located therein. Top-boxes are typically located above-ground or at least in a position in, at or near the borehole that is more suited to receipt and/or transmission of wireless signals, and for relaying these signals to the detonator down the borehole. In preferred embodiments, each top-box comprises one or more selected components of the wireless detonator of the present invention.

Transceiver: refers to any device that can receive and/or transmit wireless signals. Although the term "transceiver" traditionally encompasses a device that can both transmit and receive signals, a transceiver when used in accordance with the present invention includes a device that can function solely as a receiver of wireless signals, and not transmit wireless signals or which transmits only limited wireless signals. For example, under specific circumstances the transceiver may be located in a position where it is able to receive signals from a source, but not able to transmit signals back to the source or elsewhere. In very specific embodiments, where the transceiver forms part of a booster or primer located underground, the transceiver may be able to receive signals through-rock from a wireless source located above a surface of the ground, but may be unable to transmit signals back through the rock to the surface. In these circumstances the transceiver optionally may have the signal transmission function disabled or absent. In other embodiments, the transceiver may transmit signals only to a logger via direct electrical connection, or alternatively via short-range wireless signals.

Wired: any physical connection between any components of a wireless detonator assembly as described herein, or between any components or elements of a blasting apparatus, may be via a wired connection selected from but not limited to electrical wire or fibre optic cables etc.

Wireless: refers to there being no physical wires, cables or lines (such as electrical wires, shock tubes, LEDC, or optical cables) connecting the wireless detonator assembly of the invention or components thereof between one another or to an associated components of a blasting apparatus such as a blasting machine or a power source. Wireless signals may take any form that does not involve physical wires, cables or lines including but not limited to those comprising electromagnetic energy (including but not limited to radio signals or any frequency), acoustic energy or via magneto-inductance including signals extracted from an oscillating magnetic field.

Wireless booster: In general the expression "wireless booster" or "wireless electronic booster", or "WEB", or "electronic booster" or "wireless primer" encompasses a device comprising an explosive charge to be actuated by actuation of an associated detonator. The booster may be associated with or comprise a detonator, most preferably an electronic detonator (typically comprising at least a detonator shell and a base charge) or a wireless detonator assembly as described herein, as well as means to cause actuation of the base charge upon receipt by said primer of a signal to FIRE from at least one associated blasting machine, thereby to form a primer. For example, such means to cause actuation may include a transceiver or signal receiving means, signal processing means, and a firing circuit to be activated in the event of a receipt of a FIRE signal. Preferred components of the wireless booster (or primer) may further include means to transmit information regarding the wireless detonator assembly to other assemblies or to a blasting machine, or means to relay wireless signals to other components of the blasting apparatus. Such means to transmit or relay may form part of the function of the transceiver. Any wireless detonator assembly as described herein may form part of a wireless electronic booster or corresponding primer as described herein. Further examples of wireless electronic boosters are described in international patent publication WO2007/124539 published Nov. 8, 2007, which is incorporated herein by reference.

Wireless command signals: may comprise any form or forms of energy, wherein "forms" of energy may take any form appropriate for wireless communication of the detonators. For example, such forms of energy may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy.

Wireless detonator assembly: refers to a detonator (typically comprising at least a shell and a base charge) together with associated components for receipt and/or processing of wireless signals and means to actuate the base charge or the detonator upon receipt of a command signal to FIRE. In accordance with the wireless detonator assemblies described herein, the assemblies may include further components suitable to sense one or more environmental conditions in the immediate vicinity of the assembly, and means to activate and/or deactivate the functionality of the assembly, and thus the actuatability of the detonator, depending upon those environmental conditions. The non-detonator components may be located in physical or wired contact with the detonator, or may be separate from the detonator with a wired or wireless communication link between those components and the detonator. The other components may be intimately associated with the detonator in the assembly, or located in a separate housing, container or top-box, which may be connected to or remote from the detonator, but in the same general vicinity (e.g. within 100 m of) the detonator.

BRIEF DESCRIPTION OF THE DRAWINGS

Embodiments will now be described, by way of example only, in which.

DETAILED DESCRIPTION OF THE INVENTION

Wireless blasting systems help circumvent the need for complex wiring systems at the blast site, and associated risks of improper placement and connection of the components of the blasting system. However, the development of wireless communications systems for blasting operations has presented significant new challenges for the industry, including new safety issues.

Figure 1:
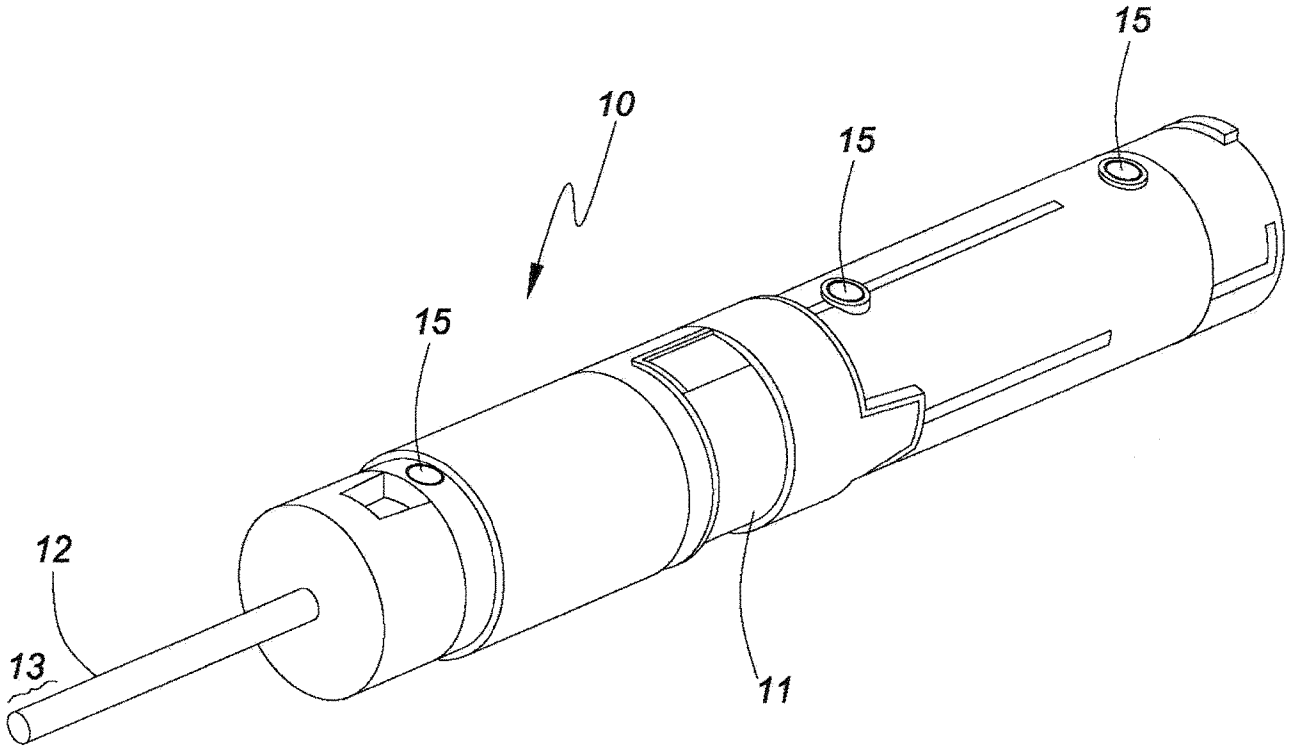
FIG. 1: is a perspective view of a wireless detonation assembly according to a first embodiment.

FIG. 1 shows a wireless detonator assembly 10 according to a first embodiment. The wireless detonator assembly 10 has a housing 11 that contains various electronic components (not visible, but discussed in more detail below). Extending from one end of the assembly is detonator 12 having a signal-line entry end (not visible) and an actuation end 13 containing a base charge (also not visible). Also shown in FIG. 1, the wireless detonator assembly 10 includes state sensors 15 integrated into housing 11 such that they can sense at least one environmental condition outside of the wireless detonator assembly, and transmit information regarding the sensed environmental condition for processing by electronic components (not shown) located within the housing.

In this particular embodiment, state sensors 15 are in the form of light detectors, such as photocells. Accordingly, the wireless detonator assembly 10 of FIG. 1 is particularly suitable for use in above-ground mining applications. Failure of the state sensors 15 to detect light is representative of the assembly 10 being located within a blast hole. Conversely, if one or more of the state sensors detect light is representative of the assembly 10 being outside a blast hole.

Figure 2:
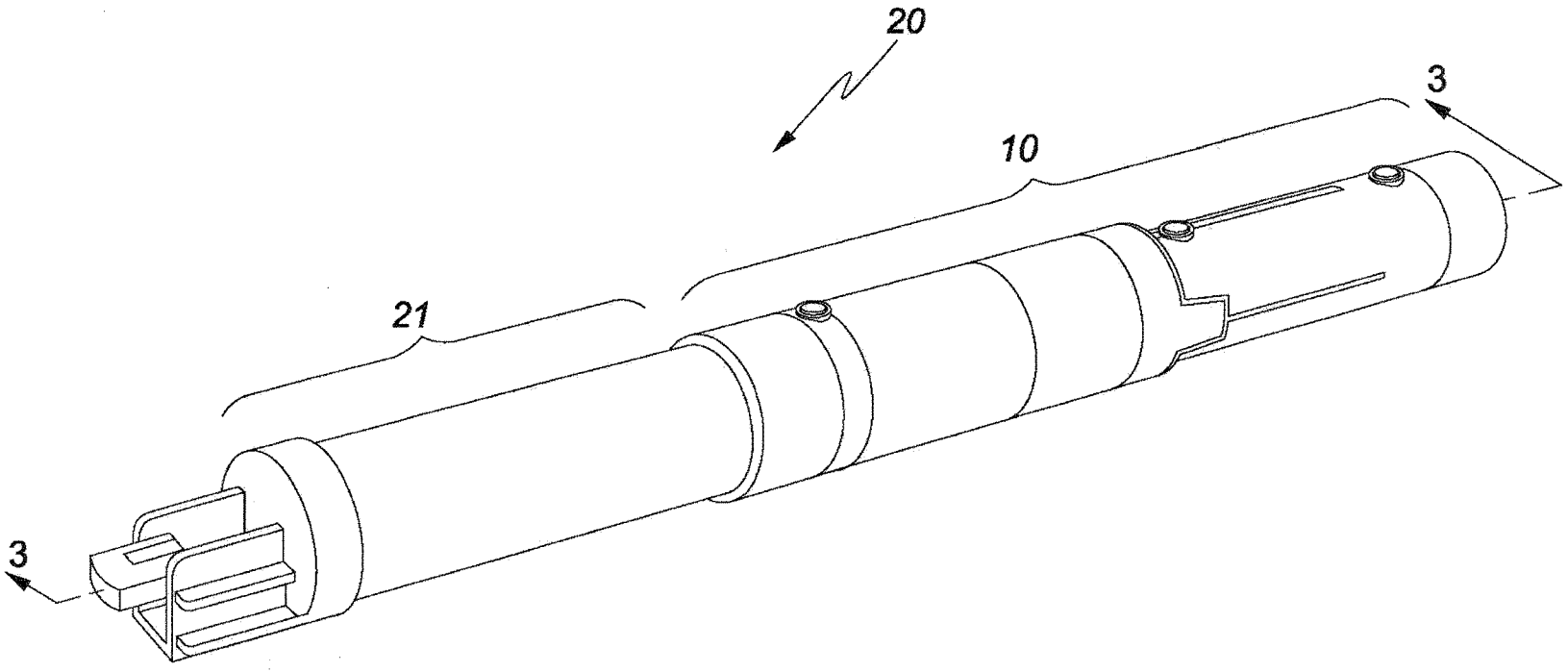
FIG. 2: is a perspective view of a wireless electronic primer according to a second embodiment.
Figure 3:
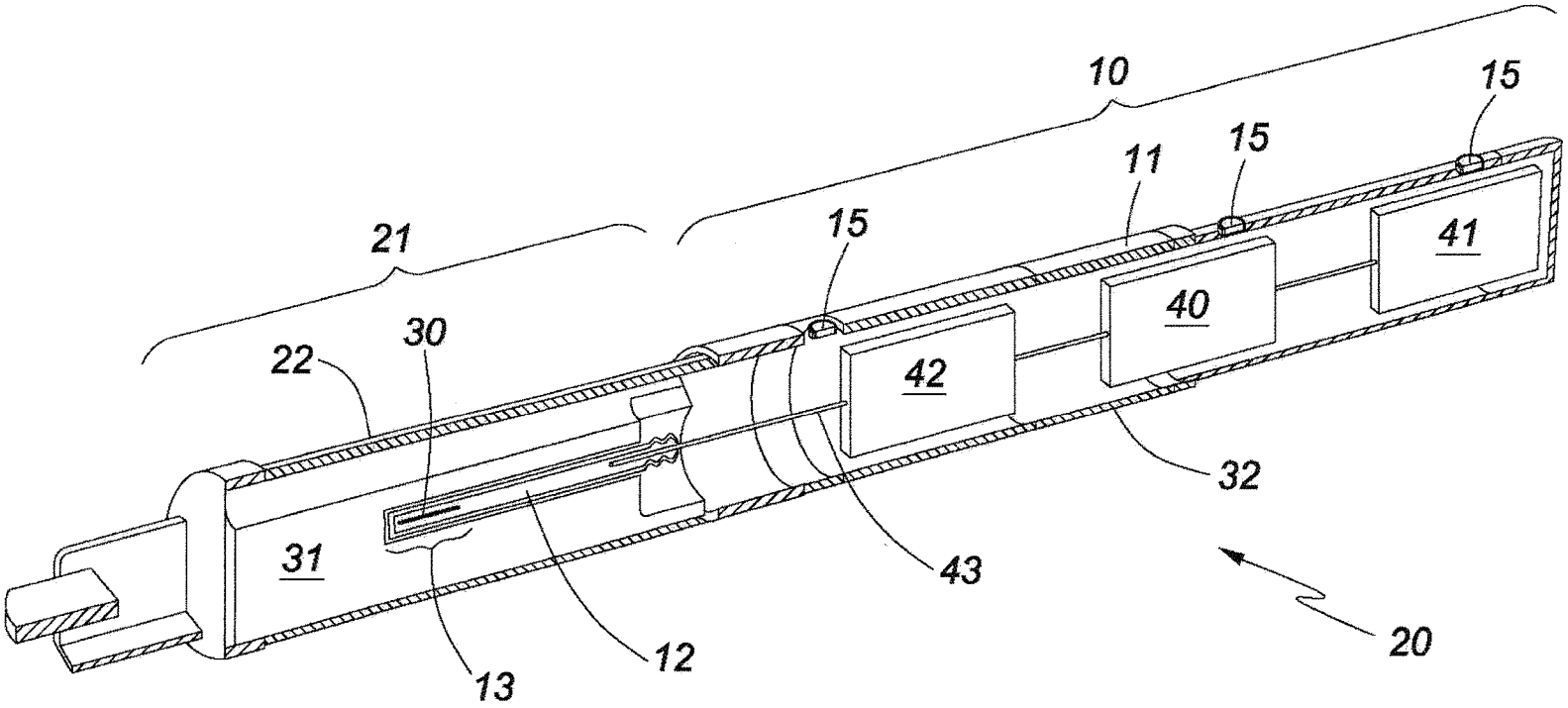
FIG. 3: is a cut-away view of the wireless electronic primer of FIG. 2.
Figure 4:
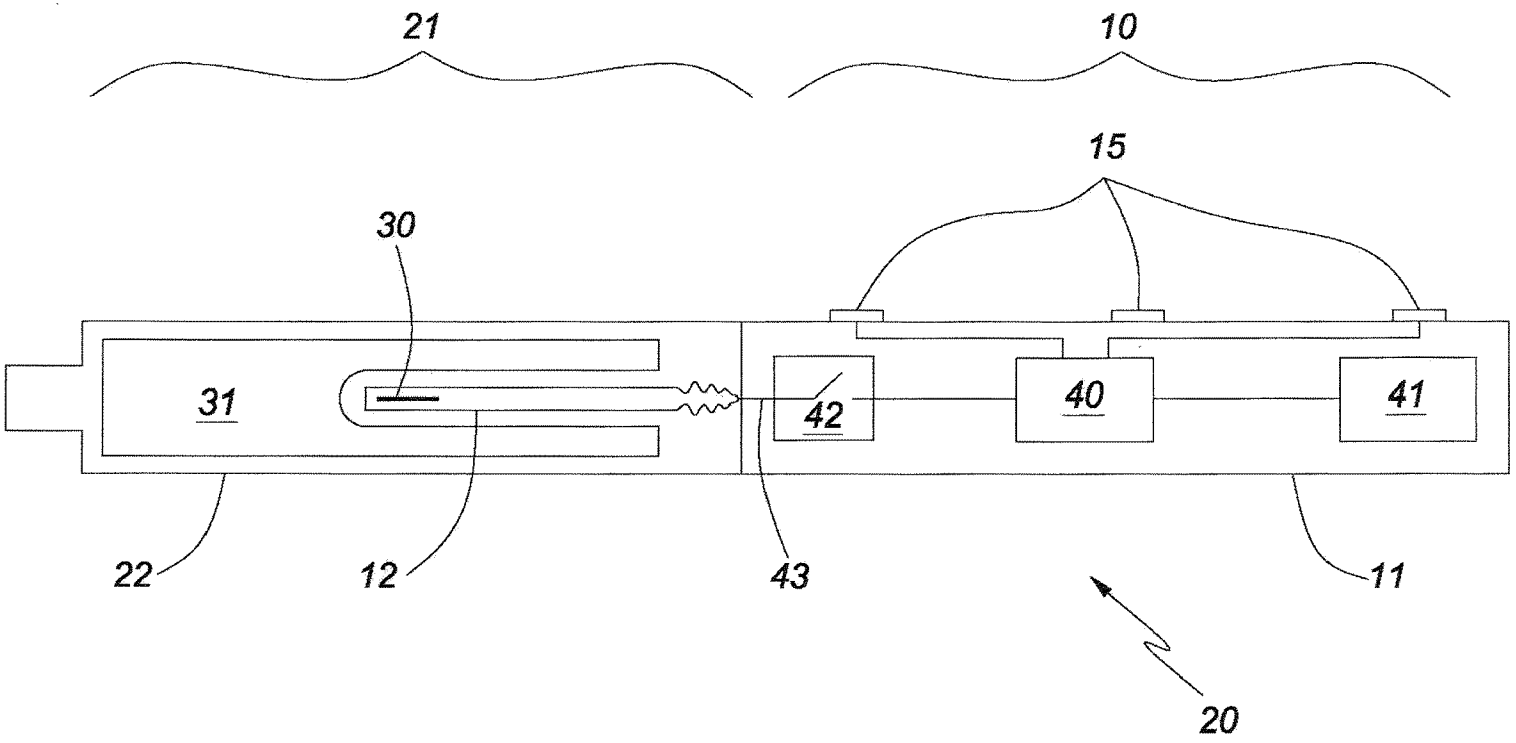
FIG. 4: is a side elevation cross-sectional view of the wireless electronic primer of FIG. 2.

FIGS. 2 to 4 show a wireless electronic primer 20 that includes the wireless detonator assembly 10 of FIG. 1, together with a booster charge 21. The booster charge 21 comprises a shell 22 for containing explosive material 31. Firing of the base charge of the detonator 12 causes the explosive material 31 of the booster charge 21 to explode.

As shown in FIGS. 3 and 4, the actuation end 13 of detonator 12 is inserted in and received into an elongate recess extending into the explosive material within booster charge 21. As particularly shown in FIG. 3, the detonator 12 includes a base charge 30, which is located within the actuation end 13. When the assembly 10 and booster charge 21 are assembled to form the primer 20, the detonator 12 extends deep into booster charge 21, and specifically into the recess of the booster charge 31. In this position, the actuation end 13 of detonator 12, and specifically base charge 30, is centrally disposed in booster charge 21 and surrounded by explosive material 31 that forms the main explosive charge of the primer 20.

FIGS. 3 and 4 show, in schematic form, an electronic circuit 32 of the wireless detonator assembly 10, which includes a command signal receiving and processing module 40, a power source (which in this embodiment is in the form of battery 41), and activation/deactivation module 42. The battery 41 provides power to the other components/modules of the electronic circuit 32. The electronic circuit 32 also includes states sensors 15.

In this embodiment, the command signal receiving and processing module 40 facilitates communication between the detonator assembly 10 and a blasting machine. To this end, the command signal receiving and processing module 40 can receive and process command signals for example via RF signal communication.

The activation/deactivation module 42 operates with the state sensors 15 to determine whether the assembly 10 should be in an active or safe mode. In this particular embodiment, when in the active mode, the module 42 allows the detonator 12 to respond to a command signal to FIRE (that is issued from the blasting machine) by actuating and initiating the base charge 30 of the primer 20. When in an safe mode, the module 42 precludes the detonator 12 from responding to a command signal to FIRE, and initiation of the base charge 30 is prevented. In other words, the activation/deactivation module 42 renders the wireless detonator assembly 10 capable of actuation, and causing detonation of the booster charge 30, in response to a command signal to FIRE only when the state sensors 15 sense that the environmental condition falls within pre-determined parameters suitable for blasting. When the environmental condition falls outside pre-determined parameters suitable for blasting, the wireless detonator assembly otherwise maintaining a safe mode incapable of receiving and/or responding to a command signal to FIRE.

Similarly, in certain cases, failure of the state sensor to sense an appropriate environmental condition may be indicative of incorrect or inappropriate placement of the assembly 10. Conversely, in certain cases, sensing of an environmental condition may be indicative of incorrect or inappropriate placement of the assembly 10. For example, in an embodiment in which the state sensors are light sensors, sense of any light is indicative of the assembly being located outside a bore hole.

In the embodiment illustrated in FIGS. 2 to 4, activation/deactivation module 42 takes the form of a switch in firing circuit 43, such that when the state sensors 15 sense environmental conditions suitable for a blast, the assembly 10 adopts or maintains an active status and the switch is closed to connect the firing circuit 43 to the base charge 30 ready to actuate the base charge (upon receipt by command signal receiving and processing module 40 of a command signal to FIRE). However, when the state sensors 15 sense environmental conditions unsuitable for blasting, the assembly adopts or maintains an safe status and the switch is open so that the base charge 30 cannot receive any signals for actuation thereof, even if the command signal receiving and processing module 40 receives and processes a command signal to FIRE.

Thus, the wireless detonator assembly 10 adopt or maintain an safe status unsuitable for receiving and/or responding to a command signal to FIRE. This has the advantage of minimizing the risk of inadvertent or accidental actuation. This increases the safety of the wireless detonator assembly 10.

In at least some alternative embodiments, the activation/deactivation module may take the form of a switch in the command signal receiving and processing module, such that when the state sensor(s) sense environmental conditions suitable for a blast, the assembly adopts or maintains an active status and the switch is closed to activate part or all of the command signal receiving and processing module and the assembly can receive and respond to a command signal to FIRE. In such an embodiment, when the state sensor(s) sense environmental conditions unsuitable for blasting, the assembly adopts or maintains a safe status and the switch is open so that part or all of the command signal receiving and processing module does not receive, process, and/or respond to a command signal to FIRE.

In the embodiments of FIGS. 1 to 4 the electronic circuit is contained entirely within or affixed to a single housing. However, is some alternative embodiments, selected electrical components/modules are maintained in an above ground top-box that is wired to a detonator beneath the ground. For example, longer wires may be employed to connect parts of the electronic circuit. Further, any of the wired connections may be replaced by wireless connections including but not limited to optical fiber, RF, IR, Bluetooth or other wireless connections such that the components of an wireless detonator assembly, as well as other associated components and/or devices, may be physically separated from one another, but nonetheless operate as part of the same device or assembly.

Figure 5:
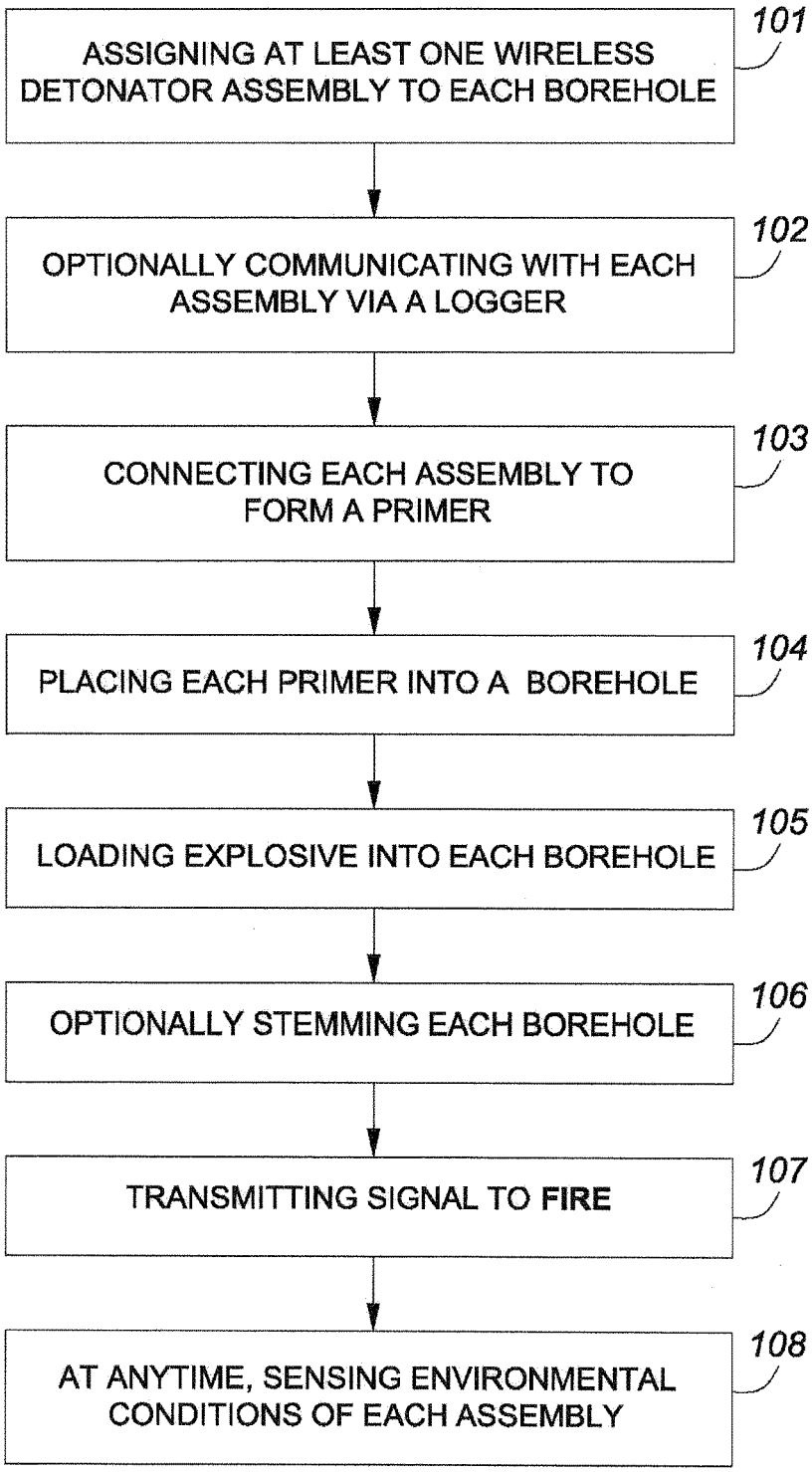
FIG. 5: is a flow chart illustrating a method of blasting rock pre-drilled with boreholes according to a third embodiment.

FIG. 5 illustrates a method of blasting rock pre-drilled with one or more boreholes. The method includes the steps of:

in step 101 assigning to each borehole at least one wireless detonator assembly as described herein;

in step 102 optionally using a hand-held device or logger to communicate with each assigned assembly to read data from and or to program data into each detonator;

in step 103 connecting each assembly to an explosive material to form a primer;

in step 104 placing each primer into the borehole;

in step 105 loading explosive into each borehole;

in step 106 optionally stemming each borehole;

in step 107 transmitting wireless command signals to control and FIRE each assembly.

The method also includes, in step 108, sensing at least one environmental condition in an immediate vicinity of each wireless detonator assembly, each assembly rendered incapable of actuation if the sensed at least one environmental condition is or becomes unfavourable or falls outside of predetermined conditions for blasting. In FIG. 5, step 108 occurs after step 107. However, in some alternative embodiments, step 108 may occur prior to, after, or concurrently with any of steps 101 to 107.

In step 107, the command signals may comprise any form of wireless signals as described herein, but in selected embodiments may be RF or magneto-inductive signals.

Optionally, the sensing of the at least one environmental condition may be specific to environmental conditions that are expected normally to be associated with a blast site, or specific to a particular blast site, such that failure to satisfy the pre-determined parameters in respect of the at least one environmental condition is indicative of the absence of the wireless detonator assembly from, or improper placement of the wireless detonator assembly at, the blast site. Alternatively, the sensing of the environmental condition(s) may be specific to environmental conditions normally expected within a borehole, such that failure to satisfy the predetermined parameters in respect of the environmental condition(s) for a particular wireless detonator assembly is indicative that the wireless detonator is not properly positioned in a borehole.

In any of the methods disclosed herein, each wireless detonator assembly may optionally further comprise a top-box remote from the detonator shell and associated components, positioned at or above ground-level, wherein the sensing of environmental conditions occurs at or above ground level at each borehole. Alternatively, each wireless detonator assembly may include a container or housing for containing or housing at least non-detonator components of the assembly.

In any of the methods disclosed herein, the sensing may sense at least one environmental condition selected from but not limited to: temperature, light, vibration, humidity, density. In any of the methods disclosed herein, optionally at least step 101 and optionally further steps, may be conducted within a 'deployment window', within which the sensing does not occur, or each wireless detonator assembly is non-responsive to such sensing, after which the sensing occurs, and each wireless detonator is responsive to the sensed environmental condition.

The method may include a further step of counting-down a time-window within which each wireless detonator assembly senses its environmental condition(s) by way of its state sensors, and outside of which each wireless detonator assembly is inactive by not sensing its environmental condition(s). In this way, each wireless detonator assembly is only able to receive and/or process a command signal to FIRE if both of the following conditions are met: the command signal to FIRE is sent to and received by each wireless detonator assembly within a specific time window, and each wireless detonator assembly 'senses' environmental conditions in its immediate vicinity appropriate and suitable for blasting.

In selected embodiments of the methods disclosed herein, the methods may further comprise an optional step of: transmitting from each wireless detonator assembly to an associated blasting machine, hand-held device or logger, data corresponding to the environment condition(s) in the immediate vicinity of each wireless detonator assembly at the blast site. In this way, a blasting machine, hand-held device or logger may collect, and optionally record or process information with regard to environmental conditions at the blast site, and their suitability for blasting, as detected by the wireless detonator assemblies. This data collection in itself presents significant safety advantages, by virtue of the wireless detonator assemblies disclosed herein.

For greater certainty and clarity, any of the wireless detonator assemblies and methods for blasting described herein may involve a single sensing event for environmental conditions in the immediate vicinity of each wireless detonator assembly (e.g. at a pre-determined time after detonator placement or on demand from the blasting machine), or infrequent sensing (for example when demanded from an associated blasting machine), or periodic or continuous sensing of environmental conditions for each wireless detonator. The embodiments disclosed herein are not limited in this regard.

Through careful investigation, the inventors have determined that certain wireless detonators and blasting systems of the prior art are problematic with regard to inadvertent or accidental actuation of the detonators. Rapid and accurate wireless communication between a blasting machine and associated wireless detonators presents a difficult challenge, regardless of the nature of the wireless communication systems. One of the most important signals that must be properly and accurately processed by a wireless detonator is the signal to FIRE. Failure of the communication systems to fire detonators on command, or improper detonator actuation at any other time, can result in a significant risk of serious injury or death for anyone handling or in close proximity to the detonators. Prevention of inadvertent or accidental detonator actuation is of paramount importance to blasting operations.

Disclosed herein are wireless detonators assemblies, and methods for blasting involving the wireless detonator assemblies. The wireless detonator assemblies utilize a novel combination of components that, in conjunction with one another, provide a means to avoid or at least substantially avoid inadvertent detonator actuation especially when the detonators are not properly positioned as required for blasting at the blast site. In certain particular embodiments, the wireless detonator assemblies comprise one or more state sensors for single, continuous or intermittent sampling or sensing of the environmental condition(s) in the immediate vicinity of each wireless detonator assembly. In this way, the wireless detonator assemblies are rendered capable of being fired only if the environmental condition(s) falls within predetermined parameters. Otherwise, at least in selected embodiments, the wireless detonator assemblies may switch into or remain in a "safe mode", in which the wireless detonator assemblies are unable to receive, or unable to act upon, a wireless command signal to FIRE.

The wireless detonator assemblies of the invention generally comprise a detonator or electronic detonator that can be used typically at the blast site together with a blasting machine. The blasting machine may transmit at least one wireless command signal to each wireless detonator assembly such as but not limited to command signals to ARM, DISARM, or FIRE. In selected embodiments the wireless detonator assembly comprises:

a detonator comprising a shell and a base charge for actuation;

command signal receiving and processing module for receiving and processing at least one wireless command signal from a blasting machine;

at least one state sensor to sense at least one environmental condition in an immediate vicinity of the wireless detonator assembly;

an activation/deactivation module to render the wireless detonator assembly capable of actuation in response to a command signal to FIRE only when the at least one state sensor senses the at least one environmental condition falls within pre-determined parameters suitable for blasting, the wireless detonator assembly otherwise maintaining a safe mode incapable of receiving and/or responding to a command signal to FIRE; and at least one power source to power the command signal receiving and processing module, the at least one state sensor, and the activation/deactivation module.

The detonator shell may take any form including those that are familiar in the art, together with a base charge typically but not necessarily located towards one end of the detonator shell. The command signal receiving and processing means may take any form suitable for this purpose, to receive any form of wireless signals including but not limited to electromagnetic signals (e.g. radio waves including low frequency and ultra low frequency radio waves, light), acoustic signals etc. For example, for command signals that use electromagnetic radiation in the radio-frequency range, a command signal receiving and processing module may comprise an RF receiver, and associated electronic components to enable processing or interpretation of the received RF signals to be acted upon by the wireless detonator assembly. For radio signals transmitted to wireless detonator assemblies positioned underground, low frequency or ultra-low frequency radio waves may be preferred, with the command signal receiving and processing module adapted accordingly.

The at least one state sensor forms an integral useful feature of the wireless detonator assembly, but each state sensor may be located at any position relative to the detonator shell: for example within or outside of the detonator shell, optionally within or part of a container or housing separate or connected to the detonator, or as a component of a top-box intended for positioning at or above ground level at the blast site, in wired or wireless short-range communication with other components of the wireless detonator assembly located down a borehole in rock. In further embodiments, in which a detonator as described herein forms part of a wireless electronic booster or corresponding primer, each state sensor or sensors may even be located on or near to a housing or casing of the wireless electronic booster or primer. For example, if the state sensor is a photocell to detect light, the state sensor may be located on or extend through a surface of the housing or the casing of the wireless electronic booster, such that detection of light by the photocell deactivates or maintains inactive a detonator located within or substantially within the housing or casing.

Each state sensor may be of a type that senses any environmental condition such as but not limited to the following non-exhaustive list of parameters within the immediate vicinity of the wireless detonator: temperature, light levels, vibration, acceleration, humidity, density of surrounding material, pressure of surrounding material, motion. Each wireless detonator assembly optionally may include more than one or indeed several different types of state sensor so that the assembly senses more than one environmental condition, wherein the wireless detonator assembly may only be active to receive or respond to a command signal to FIRE if all state sensors detect that the respective environmental condition is within parameters predetermined to be suitable for blasting.

For example, a wireless detonator assembly may comprise state sensors including a combination of a light sensor and an accelerometer. During transportation and/or placement of the wireless detonator assemblies, the light sensor will be exposed (at least periodically) to light, and a accelerometer will sense (at least periodically) accelerations caused by vibrations and other movements. Thus, any detection of light, motion, or vibration by the state sensors may result in deactivation (or maintenance) of a "safe mode" for the wireless detonator assembly, by the activation/deactivation module.

Only when the light sensor detects no light (or a reasonably low level of light), and the vibration sensor detects no vibration (or a reasonably low level of vibration) (optionally for a predetermined minimum time period), would those environmental conditions fall within the parameters of environmental conditions pre-determined to be suitable for blasting, because such conditions would correspond to expected environmental conditions upon placement of the wireless detonator assembly down a borehole in association with a booster and explosive material, in accordance with proper set-up for a blast.

The wireless detonator assemblies also each include at least one power source to power the components of each wireless detonator assembly, including but not limited to the command signal receiving and processing module and the at least one state sensor. Such a power source may simply comprise a battery or chargeable device such as a capacitor. Alternatively the power source may be a micronuclear power source, or any other means to supply electrical energy. In further embodiments, a wireless detonator may include more than one power source, including for example an active power source and a passive power source and corresponding features as taught for example in U.S. Pat. No. 7,568,429 issued Aug. 4, 2009, the subject matter of which is incorporated herein by reference.

The wireless detonator assemblies disclosed herein further comprise an activation/deactivation module, which operates in conjunction with the state sensor or sensors. The activation/deactivation module comprises any means to selectively activate and/or selectively deactivate the functionality of the wireless detonator assemblies to receive or respond to wireless command signals, and more specifically a wireless command signal to FIRE, in accordance with the environmental condition(s) detected by the state sensor(s). Only when the at least one state sensor senses that the environmental condition falls within pre-determined parameters suitable for blasting does the activation/deactivation module render the wireless detonator capable of receiving and/or capable of acting upon a command signal to FIRE.

Non-limiting examples of activation/deactivation modules will become apparent from the foregoing.

In one example, the wireless detonator assembly may further comprise a firing circuit associated with the base charge actuatable through application of a current through the firing circuit. In such embodiments, the activation/deactivation module may comprise a switch to open the firing circuit when the at least one state sensor senses environmental conditions that fall outside of pre-determined parameters suitable for blasting, thereby to prevent current flowing through the firing circuit, and to prevent actuation of the base charge, even if the command signal receiving and processing module receives a command signal to FIRE.

In another example, each wireless detonator assembly may optionally comprise a charge storage device such as a capacitor together with a firing circuit, so that upon receipt by the command signal receiving and processing module of a command signal to FIRE, the capacitor is connected via the firing circuit to the base charge. This in turn may cause a current in the firing circuit sufficient to actuate the base charge. In such embodiments, the activation/deactivation module may for example comprise discharge means to selectively bleed charge away from the charge storage device as long as at least one state sensor senses environmental conditions that fall outside pre-determined parameters suitable for blasting.

The above examples are non-limiting and merely illustrative of the types of activation/deactivation module s that may be suitable to modulate the responsiveness of a wireless detonator assembly as disclosed herein to the environmental conditions in its immediate vicinity, as sensed by the state sensor(s).

Thus, the wireless detonator assemblies disclosed herein comprise a state sensor or sensors which operate in conjunction with an activation/deactivation module to control whether or not each wireless detonator assembly is in a condition suitable to actuate the detonator (upon receipt of a command signal to FIRE). The state sensors for a particular wireless detonator assembly may be selected in terms of the environmental condition they detect, or in terms of their sensitivity to that environmental condition, according to the intended transportation, storage and intended end-use of the wireless detonator assembly. For example, the state sensors for a particular wireless detonator assembly may be selected to detect a particular environmental condition associated with a blast site, such that failure to satisfy the pre-determined parameters in respect of the environmental condition (s) may be indicative of the absence of the wireless detonator assembly from, or improper placement of the wireless detonator assembly at, the blast site. Alternatively, the at least one state sensor may be selected to sense for environmental conditions normally associated with conditions down a borehole in rock to be blasted, such as a particular temperature, humidity, pressure, or even environmental conditions associated with surrounding rock or materials such as density.

Environmental conditions such as light exposure, or the detection of motion, acceleration, or vibration, may be associated with wireless detonator assembly transportation or placement prior to blasting. Thus, in certain embodiments, state sensors may be selected accordingly whereby each wireless detonator assembly remains in an inactive condition unable to receive or respond to command signals to FIRE whilst any light or motion is detected by its state sensors.

Each state sensor may be placed in any position relative to the detonator shell, and certain positions may be preferred according to the particular environmental condition being detected. For example, some state sensors may located within each detonator shell, thus protected from damage or water infiltration during transportation or placement or the wireless detonator assembly. However, such state sensors when located within the detonator shell may optionally be able to detect at least one environmental condition on an outside of the detonator shell. Other state sensors may be required to be located on an outside of a detonator shell in order to perform their detection function, or the inside or outside of a container or housing for components of the assembly. For example, some wireless detonator assemblies may further comprise a 'top-box' remote from the detonator shell and associated components, to remain at or above ground-level when the wireless detonator assembly is placed at a blast site, wherein at least one state sensor may be associated with the top box. For example, if a particular state sensor detects whether or not a particular wireless detonator assembly can receive radio signals from a blasting machine, then unless the RF signals are suitable to travel through rock, the state sensor may be best positioned at or above ground level.

However, selected embodiments are not limited to the use of top-boxes, and encompass wireless detonator assemblies in which non-detonator components are located or housed in a housing or other container either remote from the detonator (with wireless communication with the detonator) or with a wired connection with the detonator either separate from the detonator, or physically attached to the detonator. State sensors may be located within or on or through an exterior surface or housing of any top-box, container or housing present.

Each state sensor may also be positioned on or in association with other components in the proximity of the detonator. For example, if the detonator forms part of a wireless electronic booster or corresponding primer, the assembly may be contained or substantially retained within or connected to a housing or casing for the wireless electronic booster or corresponding primer. Depending upon the nature of the state sensors to be employed, it may be preferable to have the state sensors located in such a manner that they extend through the housing or casing, or are located on an outer surface of the housing or casing. In this way, each state sensor may detect environmental conditions immediately adjacent the outside of the housing or casing. For example, if each state sensor is a photocell or light detector, any light falling upon the exterior of the housing or casing of the wireless electronic booster or primer would be indicative of non-placement or improper placement of the wireless electronic booster at the blast site. In turn, light detected by the state sensors positioned to detect light outside the housing or casing, results in transmission of, or maintenance of, a signal to an assembly located within or substantially within or connected to the housing or casing, thus to cause the assembly to adopt or retain an inactive state unsuitable for actuation.

In yet further embodiments, each wireless detonator assembly may optionally further comprise a clock to count down a 'deployment window', Each deployment window may be a pre-selected time window within which the each state sensor is inactive, or within which the wireless detonator is non-responsive to its state sensor(s). Once the clock has completed count-down of the deployment window the at least one state sensor may then start or re-start sensing the environmental condition(s) in the immediate vicinity of the assembly, so that the assembly is then responsive to the environmental condition(s). In this way, the use of a clock to provide a deployment window permits the state sensors to remain dormant (or the wireless detonator assembly non-responsive to the state sensors) at least for a period of time suitable for example for the wireless detonator assemblies to be deployed and placed down boreholes in the rock. After the deployment window has expired, the wireless detonators may then adopt or revert to a condition responsive to the environmental condition(s) in the immediate vicinity of the wireless detonator assemblies as sensed by the state sensors. Each clock may be programmed with any time for the deployment window, such as but not limited to 5, 15, 60 or 120 minutes or more depending for example upon the blasting arrangements, the blast site conditions, the distance from the place of control for the blast etc.

In still further embodiments, the wireless detonator assemblies may comprise a clock for counting down a time-window within which the wireless detonator assembly senses, or is receptive to sensing, via the state sensors, the environmental condition(s) of its immediate vicinity, wherein each wireless detonator assembly maintains an inactive state unsuitable for actuation of the detonator. In such embodiments, therefore, each wireless detonator assembly remains inactive an unable to respond to, receive and/or process a command signal to FIRE unless the assembly is within the time-window, and unless the assembly is in an environment appropriate and suitable for the blast.

In other exemplary embodiments, the wireless detonator assemblies disclosed herein may further comprise wireless signal transmission means, for transmitting to an associated blasting machine, hand-held device or logger, data corresponding to the environmental condition(s) in the immediate vicinity of each wireless detonator assembly at the blast site for each wireless detonator assembly.

In this way, any associated blasting machine, hand-held device or logger may collect and optionally process information regarding the environmental conditions at the blast site (such as the environmental conditions within boreholes at the blast site) and the suitability of those conditions for executing a blasting event. This data collection in itself presents significant safety advantages, by virtue of the wireless detonators disclosed herein.

Whilst the invention has been described with reference to specific embodiments of wireless detonator assemblies, blasting systems, and methods of blasting, a person of skill in the art would recognize that other wireless detonator assemblies, blasting systems, and methods of blasting that have not been specifically described would nonetheless lie within the intended scope of the invention. It is intended to encompass all such embodiments within the scope of the appended claims.

The invention claimed is:

1. A wireless detonator assembly for use in connection with a blasting machine that transmits at least one wireless command signal to the wireless detonator assembly, the wireless detonator assembly comprising:

a detonator comprising a shell and a base charge for actuation;

a command signal receiving and processing module for receiving and processing said at least one wireless command signal from said blasting machine;

a firing circuit associated with the base charge, the firing circuit comprising a charge storage device such that, upon receipt by the command signal receiving and processing module of a command signal to FIRE, the charge storage device can discharge a current in the firing circuit, the current being sufficient to actuate the base charge;

at least one state sensor to sense at least one environmental condition in an immediate vicinity of the wireless detonator assembly;

an activation/deactivation module to render the wireless detonator assembly capable of actuation in response to a command signal to FIRE when said at least one state sensor senses that the at least one environmental condition falls within pre-determined parameters suitable for blasting, the wireless detonator assembly otherwise maintaining a safe mode incapable of receiving and/or responding to a command signal to FIRE, the activation/deactivation module is configured to selectively bleed charge away from the charge storage device as long as the at least one state sensor senses environmental conditions that fall outside the pre-determined parameters suitable for blasting; and a container or housing for containing or housing, without the detonator, at least the command signal receiving and processing module, the firing circuit, the at least one state sensor, and the activation/deactivation module, with a wired or wireless link between the detonator and the command signal receiving and processing module, the firing circuit, the at least one state sensor, or the activation/deactivation module.

2. The wireless detonator assembly of claim 1, wherein the command signal receiving and processing module comprises an RF receiver.

3. The wireless detonator assembly of claim 1, wherein the at least one state sensor senses at least one environmental condition of the detonator assembly, such that failure to detect an appropriate environmental condition is indicative of the absence of the wireless detonator assembly from, or improper placement of the wireless detonator at, the blast site.

4. The wireless detonator assembly of claim 1, wherein the at least one state sensor senses for at least one environmental condition that is normally associated with conditions down a borehole in rock to be blasted.

5. The wireless detonator assembly of claim 1, further comprising at least one state sensor located within said detonator shell.

6. The wireless detonator assembly of claim 1, further comprising a top-box remote from the detonator shell and associated components, to remain at or above ground-level when the wireless detonator assembly is placed at a blast site.

7. The wireless detonator assembly of claim 1, wherein said activation/deactivation module comprises a switch to open the firing circuit when said at least one state sensor senses that the at least one environmental condition falls outside of said pre-determined parameters suitable for blasting, thereby to prevent actuation of the base charge even upon receipt by the command signal receiving and processing module of a command signal to FIRE.

8. The wireless detonator assembly of claim 1, further comprising a clock to count down a deployment window, within which the at least one state sensor is inactive, or within which the wireless detonator is non-responsive to the at least one state sensor, after which the at least one state sensor senses the at least one environmental condition in the immediate vicinity of the detonator assembly, and the detonator assembly is responsive to the at least one environmental condition.

9. The wireless detonator assembly of claim 1, further comprising a clock to count-down a time-window for a blasting event, wherein the state sensors are active to sense the at least one environmental condition of the immediate vicinity of the assembly only within said time-window.

10. The wireless detonator assembly of claim 1, wherein each state sensor senses at least one environmental condition selected from: temperature, light, motion, acceleration, vibration, humidity, density, and pressure.

11. The wireless detonator assembly of claim 1, further comprising wireless signal transmission means, for transmitting to an associated blasting machine, hand-held device or logger, data corresponding to the environment condition in its immediate vicinity at the blast site.

12. A method of blasting rock pre-drilled with boreholes, the method comprising the steps of:

1) assigning to each borehole at least one wireless detonator assembly comprising:

a detonator comprising a shell and a base charge for actuation;

a command signal receiving and processing module for receiving and processing said at least one wireless command signal from a blasting machine;

a firing circuit associated with the base charge, the firing circuit comprising a charge storage device such that, upon receipt by the command signal receiving and processing module of a command signal to FIRE, the charge storage device can discharge a current in the firing circuit, the current being sufficient to actuate the base charge;

at least one state sensor to sense at least one environmental condition in an immediate vicinity of the wireless detonator assembly;

an activation/deactivation module to render the wireless detonator assembly capable of actuation in response to a command signal to FIRE when said at least one state sensor senses that the at least one environmental condition falls within pre-determined parameters suitable for blasting, the wireless detonator assembly otherwise maintaining a safe mode incapable of receiving and/or responding to a command signal to FIRE, the activation/deactivation module is configured to selectively bleed charge away from the charge storage device as long as the at least one state sensor senses environmental conditions that fall outside the pre-determined parameters suitable for blasting; and a container or housing for containing or housing, without the detonator, at least the command signal receiving and processing module, the firing circuit, the at least one state sensor, and the activation/deactivation module, with a wired or wireless link between the detonator and the command signal receiving and processing module, the firing circuit, the at least one state sensor, or the activation/deactivation module;

2) optionally using a hand-held device or logger to communicate with each assigned assembly to read data from and/or program data into each assembly;

3) connecting each assembly to an explosive material to form a primer;

4) placing each primer into the borehole;

5) loading explosive into each borehole;

6) optionally stemming each borehole;

7) transmitting wireless command signals to control and FIRE each detonator;

wherein at any time the method further comprises: sensing at least one environmental condition in an immediate vicinity of each wireless detonator assembly, each assembly rendered incapable of actuation at any time if the sensed environmental condition is or becomes outside of pre-determined parameters for blasting.

13. The method of claim 12, wherein in step 7) the command signals are RF signals.

14. The method of claim 12, wherein the sensing of the at least one environmental condition is specific to environmental conditions associated with the blast site, such that failure to detect favourable environmental conditions for blasting is indicative of the absence of the wireless detonator assembly from, or improper placement of the wireless detonator assembly at, the blast site.

15. The method of claim 12, wherein the sensing of the at least one environmental condition is specific to environmental conditions normally expected within a borehole, whereby when sensing of the at least one environmental condition that is or becomes outside of the pre-determined parameters for a particular wireless detonator assembly is indicative that the wireless detonator assembly is improperly positioned in, or not positioned in, a borehole.

16. The method of claim 12, wherein each wireless detonator assembly further comprises a top-box remote from the detonator shell and associated components, positioned at or above ground-level, wherein the step of receiving wireless command signals occurs at or above ground level at each borehole.

17. The method of claim 12, wherein at least step 1) and optionally further steps, are conducted within a deployment window, within which the sensing does not occur or each wireless detonator assembly is non-responsive to such sensing, after which the sensing occurs, and each wireless detonator assembly is responsive to its environmental conditions.

18. The method of claim 12, wherein the sensing senses at least one environmental condition selected from: temperature, light, motion, acceleration, vibration, humidity, density, and pressure.

19. The method of claim 12, further comprising the step of:

transmitting from each wireless detonator assembly to an associated blasting machine, hand-held device or logger, data corresponding to the environment condition(s) in the immediate vicinity of each wireless detonator assembly at the blast site.

20. The method of claim 12, further comprising a step of assigning a time-window to the blast, each wireless detonator assembly comprising a clock for counting-down the time-window, wherein the step of sensing only continues or occurs within the time-window.

21. A wireless electronic primer for use in connection with a blasting machine, said blasting machine controlling said wireless electronic primer via at least one wireless command signal, the wireless electronic primer comprising:

a wireless detonator assembly comprising:

a detonator comprising a shell and a base charge for actuation;

a command signal receiving and processing module for receiving and processing said at least one wireless command signal from said blasting machine;

a firing circuit associated with the base charge, the firing circuit comprising a charge storage device such that, upon receipt by the command signal receiving and processing module of a command signal to FIRE, the charge storage device can discharge a current in the firing circuit, the current being sufficient to actuate the base charge;

at least one state sensor to sense at least one environmental condition in an immediate vicinity of the wireless detonator assembly;

an activation/deactivation module to render the wireless detonator assembly capable of actuation in response to a command signal to FIRE when said at least one state sensor senses that the at least one environmental condition falls within pre-determined parameters suitable for blasting, the wireless detonator assembly otherwise maintaining a safe mode incapable of receiving and/or responding to a command signal to FIRE, the activation/deactivation module is configured to selectively bleed charge away from the charge storage device as long as the at least one state sensor senses environmental conditions that fall outside the pre-determined parameters suitable for blasting; and a container or housing for containing or housing, without the detonator, at least the command signal receiving and processing module, the firing circuit, the at least one state sensor, and the activation/deactivation module, with a wired or wireless link between the detonator and the command signal receiving and processing module, the firing circuit, the at least one state sensor, or the activation/deactivation module;

an explosive charge in operative association with said detonator, such that actuation of said base charge causes actuation of said explosive charge; and said command signal receiving and processing module in signal communication with said detonator such that upon receipt of a command signal to FIRE by said command signal receiving and processing module said base charge and thus said explosive charge are actuated, providing said at least one state sensor senses environmental conditions that fall within pre-determined parameters suitable for blasting.

22. A wireless detonator assembly comprising:

a detonator including a shell and a base charge;

a receiver configured to wirelessly receive at least one command signal from a blasting machine;

a firing circuit comprising a charge storage device, the firing circuit configured to, upon receipt of a command signal to FIRE by the receiver, control the charge storage device to discharge current sufficient to actuate the base charge;

a sensor configured to sense at least one environmental condition in an immediate vicinity of the wireless detonator assembly; and an activation/deactivation module configured to render the wireless detonator assembly capable of actuation the base charge in response to a command signal to FIRE when the sensor senses that the at least one environmental condition falls within pre-determined parameters suitable for blasting, and otherwise maintaining the wireless detonator assembly in a safe mode incapable of receiving and/or responding to a command signal to FIRE, and wherein the activation/deactivation module is further configured to selectively bleed charge away from the charge storage device while the sensor senses environmental conditions that fall outside the pre-determined parameters suitable for blasting, and wherein the receiver, the firing circuit, the sensor, and the activation/deactivation module are commonly housed separately from the detonator.

* * * * *